US007182630B1

(12) United States Patent
Su

(10) Patent No.: US 7,182,630 B1
(45) Date of Patent: Feb. 27, 2007

(54) COMMON LEAD DEVICE FOR SATA AND PERIPHERY POWER CONNECTORS

(75) Inventor: Steven Su, Taoyuan (TW)

(73) Assignee: Enermax Technology Corporation, Taoyuan (TW)

( * ) Notice: Subject to any disclaimer, the term of this patent is extended or adjusted under 35 U.S.C. 154(b) by 0 days.

(21) Appl. No.: 11/211,611

(22) Filed: Aug. 26, 2005

(51) Int. Cl.
*H01R 11/00* (2006.01)

(52) U.S. Cl. ..... 439/502

(58) Field of Classification Search ..... 439/502, 439/505

See application file for complete search history.

(56) References Cited

U.S. PATENT DOCUMENTS

| | | | | |
|---|---|---|---|---|
| 6,881,098 | B2 * | 4/2005 | Jeansonne et al. | 439/638 |
| 6,962,506 | B1 * | 11/2005 | Krobusek | 439/502 |
| 7,004,787 | B2 * | 2/2006 | Milan | 439/502 |
| 7,094,971 | B2 * | 8/2006 | Johnsen | 174/84 R |

* cited by examiner

*Primary Examiner*—Khiem Nguyen
(74) *Attorney, Agent, or Firm*—Troxell Law Office, PLLC

(57) ABSTRACT

A common lead device applied to SATA and periphery power connectors in a computer is described. The device integrates a plurality of power cords output from a power supply into common power cords, by which different voltages are provided.

4 Claims, 5 Drawing Sheets

COMMON LEAD DEVICE FOR SATA AND PERIPHERY POWER CONNECTORS

CROSS-REFERENCES TO RELATED APPLICATIONS

Not Applicable

STATEMENT REGARDING FEDERALLY SPONSORED RESEARCH OR DEVELOPMENT

Not Applicable

DESCRIPTION

1. Field of Invention

The present invention relates to a common lead device for SATA and periphery power connectors. The device integrates a plurality of power cord outputs from a power supply in a computer into common power cords, by which different voltages are provided concurrently.

2. Background

Computer hosts, servers, or mechanical and electrical equipment are frequently equipped with power supplies that chiefly transfer alternating current into stable direct current of different voltages and provide the same for each component in the computer hosts or servers.

The direct current output from the power supplies usually accompanying these voltages of +12V, +5V and +3.3V are led out primarily by 4 pin (4P) power connectors and SATA power connectors (the trademark "SATA" belongs to its own company). In general, the 4P power connectors lead out output voltages of +12V and +5V; the SATA power connectors lead out output voltages of +12V, +5V and +3.3V.

Referring to FIG. 1, a 4P power connector 1 conducts four power cords, which are a yellow power cord 11 for outputting the voltage of +12V, two black power cords 12, 13 for grounding, and a red power cord 14 for outputting the voltage of +5V, respectively.

Referring to FIG. 2, a SATA power connector 2 conducts five power cords, which are a yellow power cord 21 for outputting the voltage of +12V, a black power cord 22 for grounding, a red power cord 23 for outputting the voltage of +5V, another black power cord 24 for grounding, and an orange power cord 25 for outputting the voltage of +3.3V, respectively.

As above, the 4P power connector 1 and the SATA power connector 2 carry different voltages, and also have different quantity power cords. In practice, the 4P power connector 1 and the SATA power connector 2 separately lead out four power cords 11–14 and five power cords 21–25, of which terminals are connected in series, when implemented in the power supply. As a result, the number of power cords conducted from the power supply becomes large if applying a great number of different output voltages inquired plural suites of the 4P power connectors 1 and the SATA power connectors 2. Furthermore, the internal design of the power supply needs to be more complicated to accommodate the numerous cables, increasing manufacturing costs.

SUMMARY OF INVENTION

An objective of the present invention is to provide a common lead device for SATA and periphery power connectors. The device applied to a power supply integrates a plurality of separate power cords into common power cords, by which different voltages are also provided. Hence, the quantity of output power cords is reduced.

BRIEF DESCRIPTION OF THE DRAWINGS

The foregoing aspects, as well as many of the attendant advantages and features of this invention, will become more apparent by reference to the following detailed description, when taken in conjunction with the accompanying drawings, wherein.

DETAILED DESCRIPTION OF THE INVENTION (PREFERRED EMBODIMENTS)

The present invention discloses integrating different numbers of output power cords into common power cords, by which different DC power with voltages are provided and lead out using both the 4P power connector 1 and the SATA power connector 2.

Accordingly, a common lead device for SATA and periphery power connectors is provided. The device, particularly applied to a power supply, integrates a plurality of separate power cords into common power cords, through which different voltages are provided. The quantity of output power cords is thus reduced.

Figure 1:
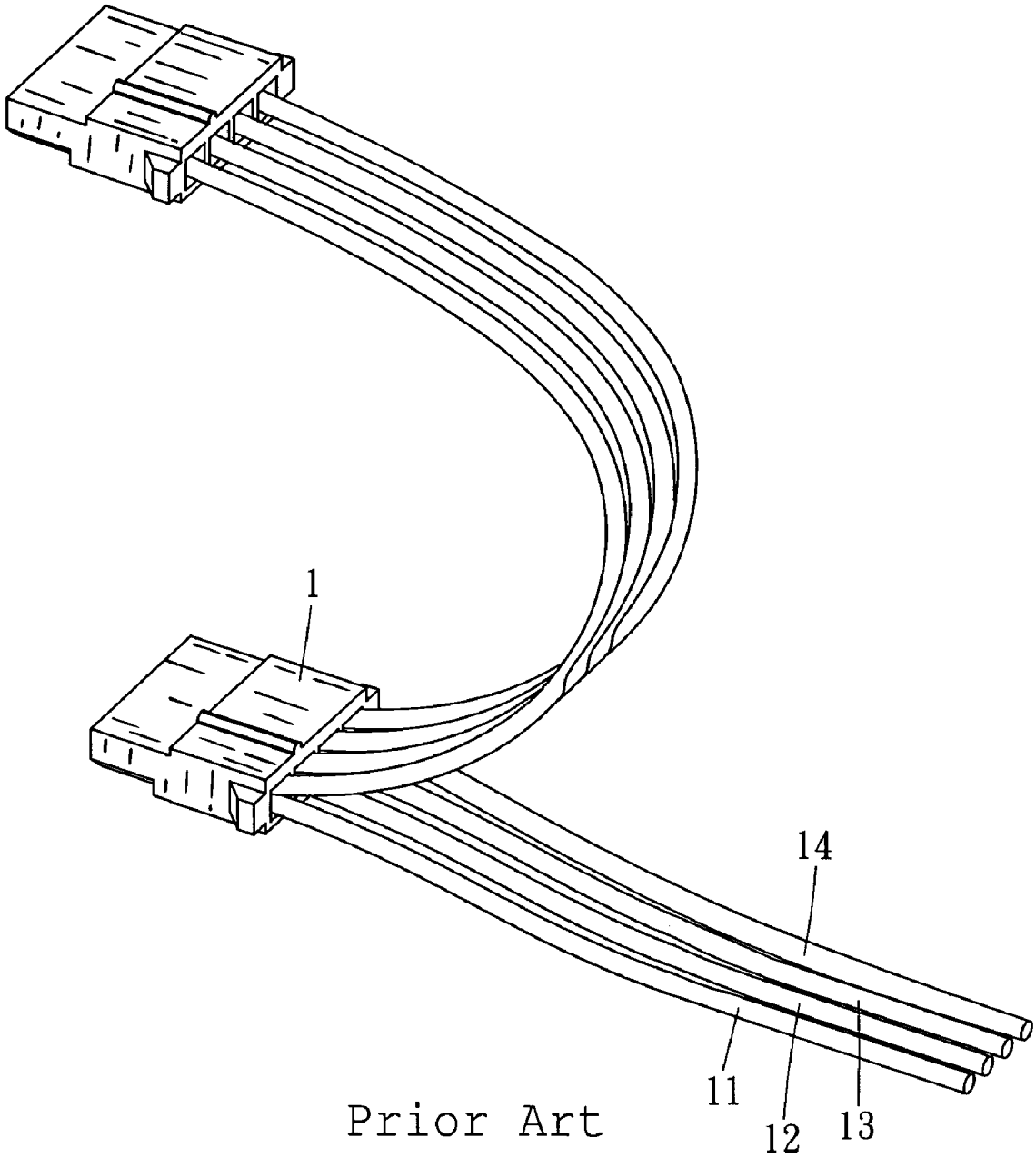
Prior Art Fig. 1
FIG. 1 is a diagram of a conventional 4P power connector with four power cords.
Figure 2:
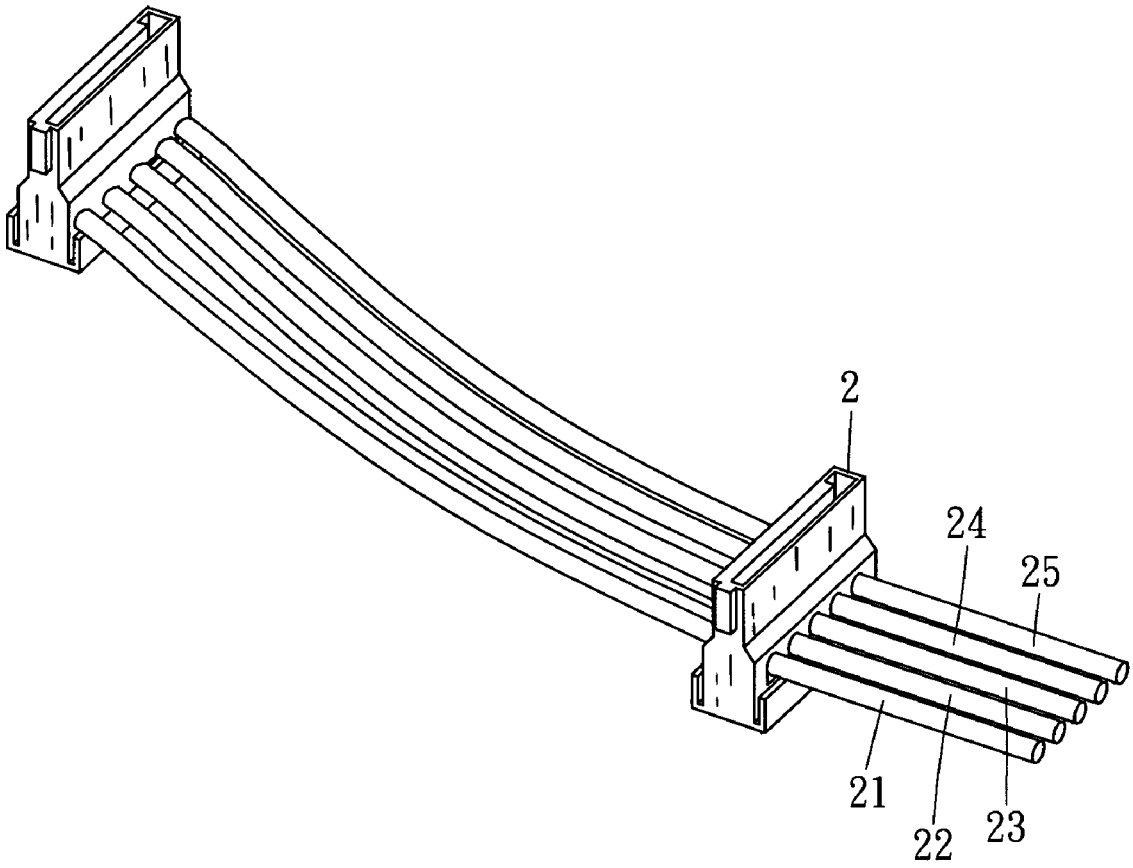
Prior Art Fig. 2
FIG. 2 is a diagram of a conventional SATA power connector with five power cords.
Figure 3:
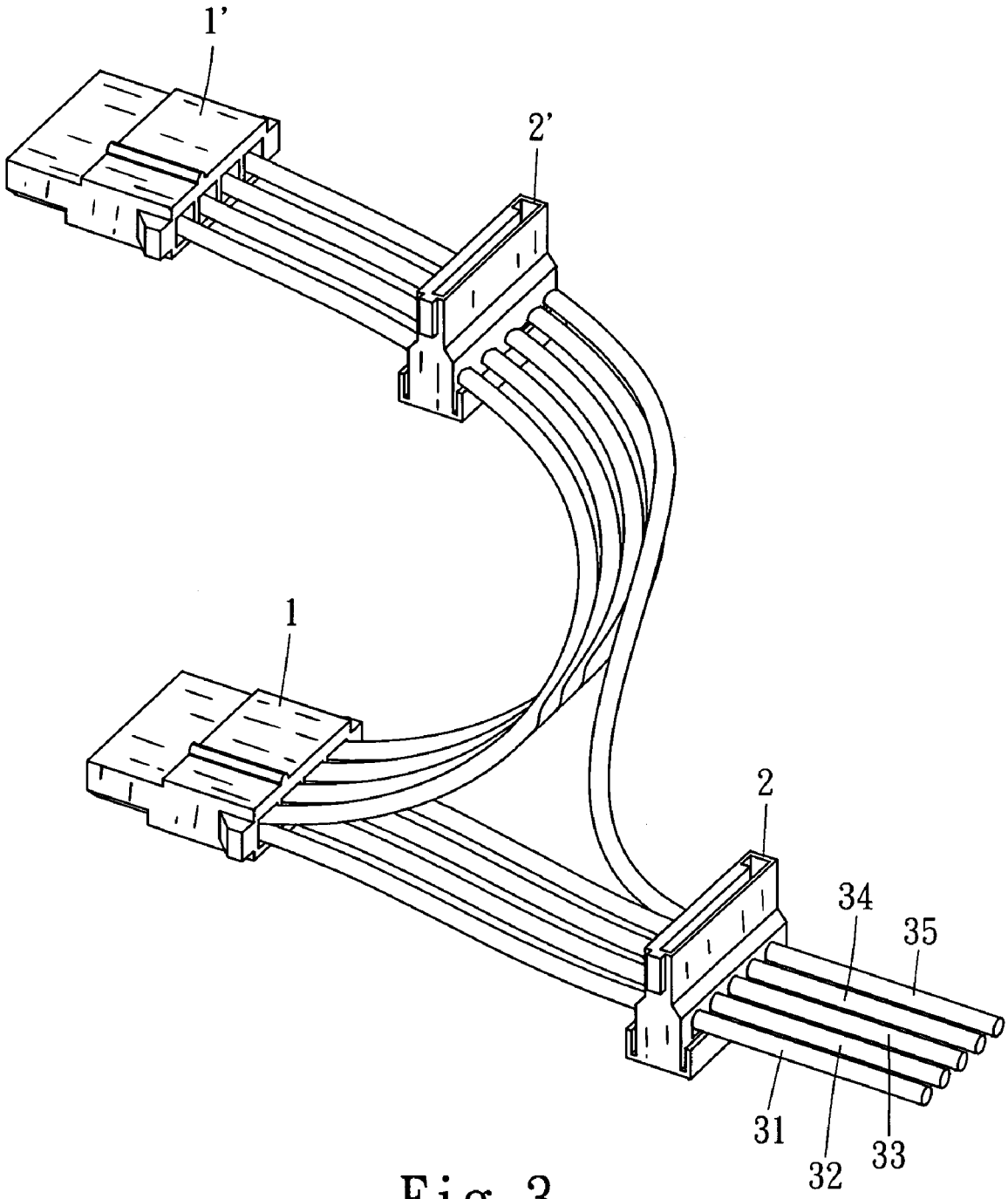
FIG. 3 is a diagram of a common lead device for SATA and periphery power connectors according to one embodiment of the present invention.

FIG. 3 illustrates a stereoscopic view of a common lead device for SATA and periphery power connectors in accordance with one embodiment of the invention. A power supply outputs five power cords 31–35 collectively, wherein a first yellow power cord 31 is provided for outputting the voltage of +12V, a second black power cord 32 is provided for grounding, a third red power cord 33 is provided for outputting the voltage of +5V, a forth black power cord 34 is provided for grounding, and a fifth orange power cord 35 is provided for outputting the voltage of +3.3V. These five power cords 31–35 are all applied to a SATA power connector 2. On the other hand, four power cords 31–34 except the power cord 35 are coupled to a 4P power connector 1.

It is noted that the sequence of the third red power cord 33 and the forth black power cord 34 is opposite to that of the third black power cord 13 for grounding and the forth red power cord 14 for outputting +5V originally from the 4P power connector 1. An adequate sequence is further modified for corresponding to each other, i.e. through conductive flakes of the 4P power connector 1, 1'. Therefore, the 4P power connector 1 and the SATA power connector 2 are both led out by these five common power cords 31–35, and provide the voltages of +12V, +5V and +3.3V as well as the grounding.

As shown in FIG. 3, it is not limited to connecting the common power cords 31–35 with only one 4P power connector 1 and one SATA power connector 2. Plurality of 4P power connectors 1' and SATA power connectors 2' may be connected in series to meet the requirements of voltages for different hardware, such as motherboards, hard disks, floppies, CD-ROMs, CD burners, heat sinks, and other periphery equipment.

Figure 4:
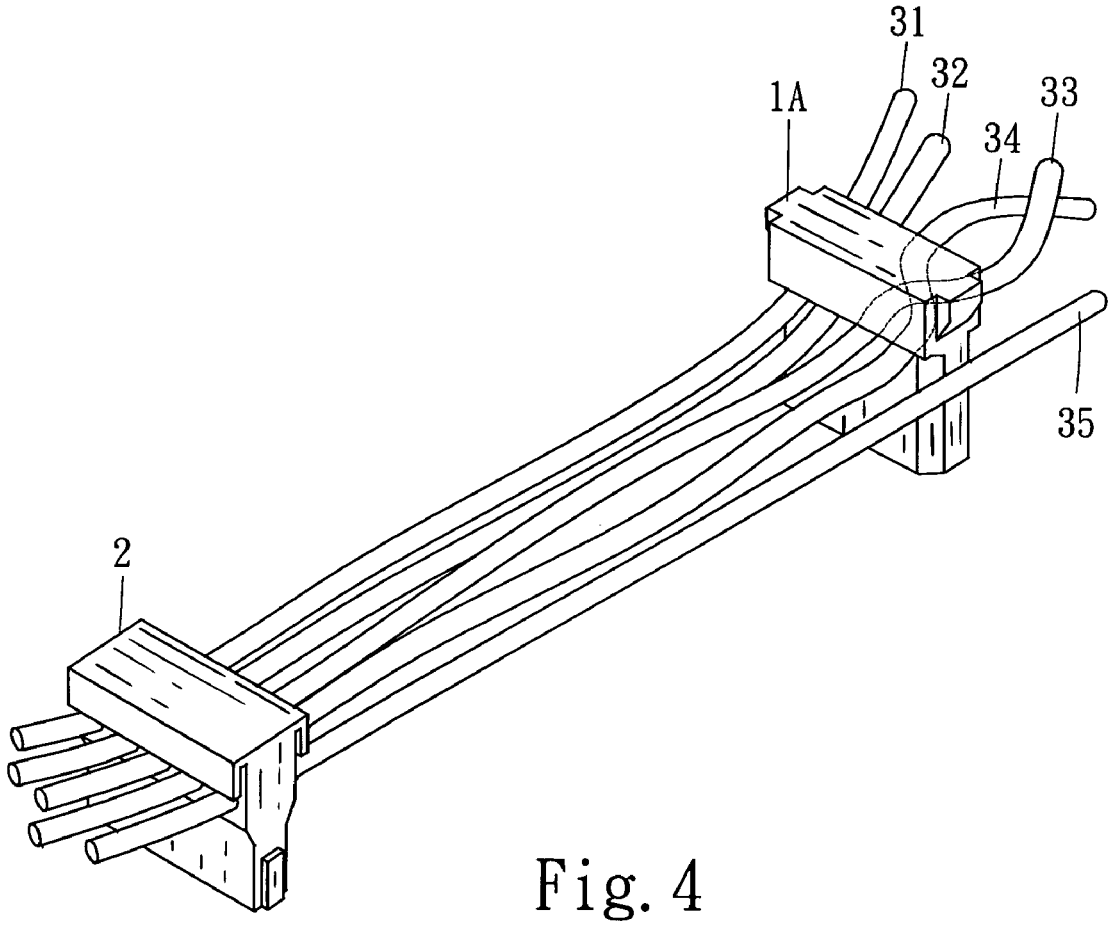
FIG. 4 is a diagram of a common lead device for SATA and periphery power connectors according to another embodiment of the present invention.

Referring to FIG. 4, the opposite sequence of the third and the forth power cords in the SATA power connector 2 and the 4P power connector 1 is modified by a 4P power connector with an inner adapter 1A. In this embodiment, the third red power cord 33 for outputting +5V and the forth black power cord 34 for grounding cross each other inside the connector with the inner adapter 1A, so as to change the sequence thereof.

Figure 5:
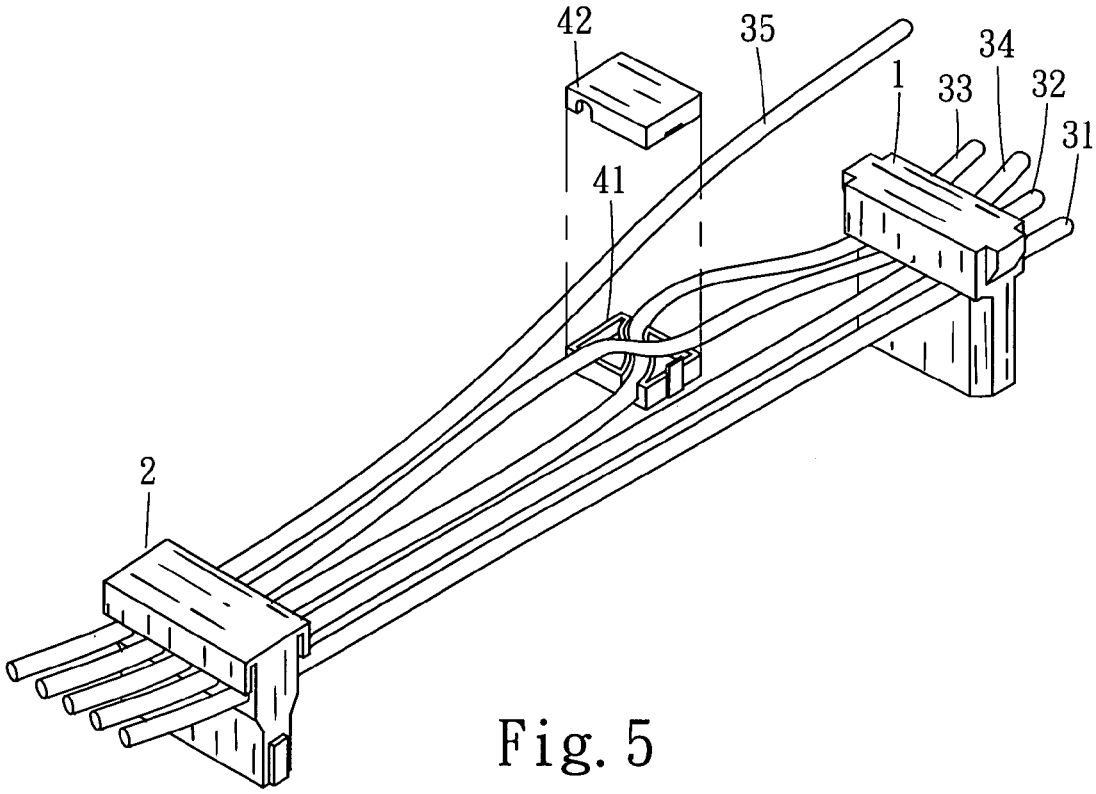
FIG. 5 is a diagram of a common lead device for SATA and periphery power connectors according to still another embodiment of the present invention.
Figure 6:
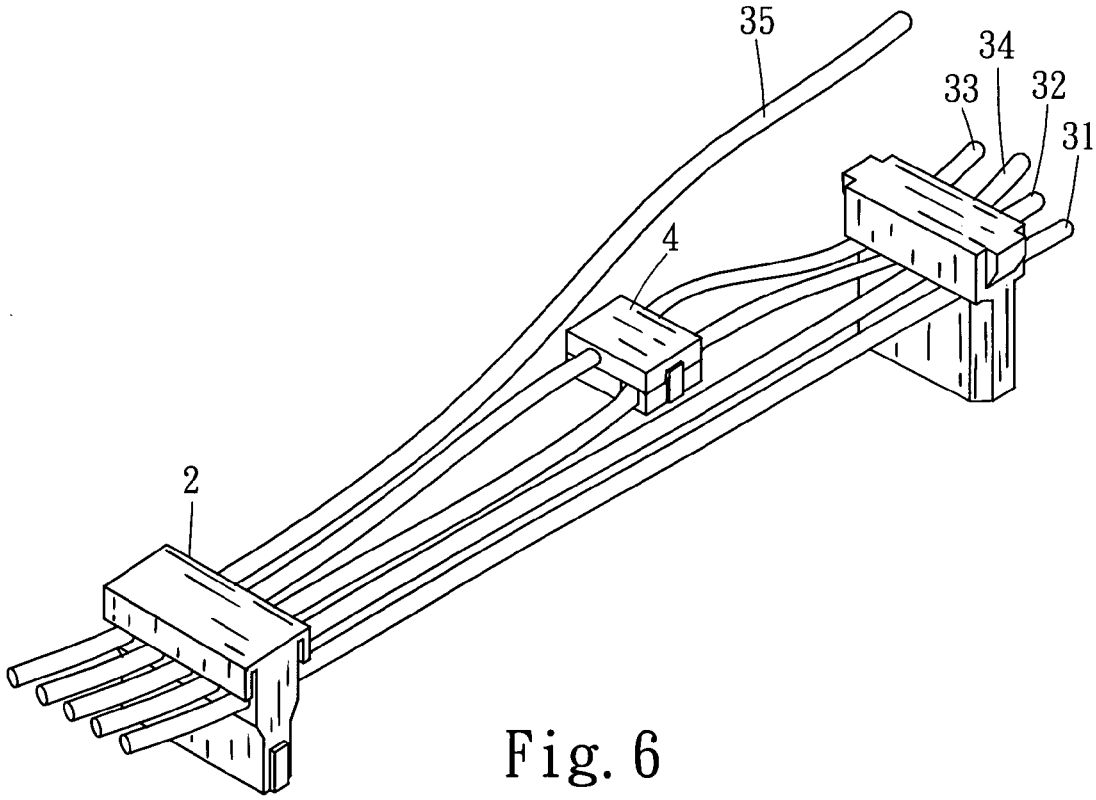
FIG. 6 illustrates a stereoscopic view of the embodiment in FIG. 5.

Referring to FIG. 5 and FIG. 6, the opposite sequence is modified by an outer adapter 4 composed of a socket 41 and a cap 42. In this embodiment, the third red power cord 33 for outputting +5V and the forth black power cord 34 for grounding cross each other outside the connectors, so as to change the sequence thereof.

What is claimed is:

1. A common lead device for SATA and periphery power connectors, said device collectively leading out a first, a second, a third, a fourth, and a fifth power cords (31, 32, 33, 34,35) output from a power supply, wherein the five power cords (31–35) are all provided for a SATA power connector (2), and the four power cords (31–34) except the fifth power cord (35) are coupled to a 4P power connector (1); wherein a difference in sequence between partial power cords of the 4P power connector (1) and the SATA power connector (2) is modified for corresponding to each other by a conductive flake of the 4P power connector (1, 1') such that the 4P power connector (1) and the SATA power connector (2) are both led out by the five common power cords (31–35), and provide voltages of +12V, +5V and +3.3V and two grounding connections.

2. The device of claim 1, wherein the five power cords (31–35) are further connected to a plurality of 4P power connectors (1') and a plurality of SATA power connectors (2').

3. The device of claim 1, wherein a difference in sequence between partial power cords of the 4P power connection (1) and the SATA power connector (2) is modified by a 4P power connector with an inner adapter (1A), and thereby the third power cord (33) for outputting +5V and the fourth power cord (34) for grounding cross each other inside the connector with the inner adapter (1A), so as to reverse a sequence of the third power cord (33) and the fourth power cord (34).

4. The device of claim 3, wherein a difference in sequence between partial power cords of the 4P power connector (1) and the SATA power connector (2) is modified by an outer adapter (4) composed of a socket (41) and a cap (42), and thereby the third power cord (33) for outputting +5V and the fourth power cord (34) for grounding cross each other outside, so as to change the different sequence.

* * * * *